US008922607B2

(12) United States Patent
Bellmyer

(10) Patent No.: US 8,922,607 B2
(45) Date of Patent: Dec. 30, 2014

(54) DIRECT THERMAL AND THERMAL TRANSFER SHIPPING LABEL AND METHODS OF MAKING SAME

(71) Applicant: Ward Kraft, Inc., Fort Scott, KS (US)

(72) Inventor: Johnny Bellmyer, Fort Scott, KS (US)

(73) Assignee: Ward Kraft, Inc., Fort Scott, KS (US)

( * ) Notice: Subject to any disclaimer, the term of this patent is extended or adjusted under 35 U.S.C. 154(b) by 0 days.

(21) Appl. No.: 14/282,158

(22) Filed: May 20, 2014

(65) Prior Publication Data

US 2014/0340458 A1 Nov. 20, 2014

Related U.S. Application Data

(60) Provisional application No. 61/825,439, filed on May 20, 2013.

(51) Int. Cl.
*B41J 2/32* (2006.01)
*B41J 3/407* (2006.01)

(52) U.S. Cl.
CPC ..... *B41J 3/4075* (2013.01)
USPC ..... 347/171

(58) Field of Classification Search
USPC ..... 347/171, 173, 186, 192, 193, 218; 358/1.18
See application file for complete search history.

(56) References Cited

U.S. PATENT DOCUMENTS

| | | | | |
|---|---|---|---|---|
| 5,172,136 | A * | 12/1992 | Stephenson, III | 347/173 |
| 6,795,103 | B2 * | 9/2004 | Okayasu et al. | 347/192 |
| 2001/0019352 | A1 * | 9/2001 | Miyazaki | 347/218 |
| 2008/0316534 | A1 * | 12/2008 | McGarry et al. | 358/1.18 |
| 2011/0102485 | A1 * | 5/2011 | VanDemark et al. | 347/8 |

* cited by examiner

*Primary Examiner* — Kristal Feggins
(74) *Attorney, Agent, or Firm* — Lathrop & Gage LLP

(57) ABSTRACT

A method for printing a label having a first side, a second side, and a border comprises the step of providing a printing apparatus. The border is coated with an adhesive at the second side and a release liner is releasably secured thereto. The apparatus comprises a direct thermal printer having a first print head and a thermal transfer printer adjacent thereto and having a second print head. The method includes the step of coating the second side with a direct thermal coating, and the step of situating the label underneath the printing apparatus such that each of the first print head and the second print head face the first side. A controller is used to cause the direct thermal printer to print a second indicia on the second side, and to cause the thermal transfer printer to print a first indicia on the first side.

21 Claims, 12 Drawing Sheets

DIRECT THERMAL AND THERMAL TRANSFER SHIPPING LABEL AND METHODS OF MAKING SAME

CROSS-REFERENCE TO RELATED APPLICATIONS

This application claims priority to U.S. Provisional Patent Application Ser. No. 61/825,439 filed May 20, 2013, the disclosure of which is incorporated herein by reference in its entirety.

FIELD OF THE INVENTION

The invention relates generally to the field of shipping labels. More specifically, the invention relates to methods for printing indicia on shipping labels.

SUMMARY

Systems and methods for printing labels are disclosed herein. According to an embodiment, a method for printing a label having a first side, a second side opposing the first side, and a border comprises the step of providing a printing apparatus. The border is coated with an adhesive at the second side and a release liner is releasably secured thereto. The printing apparatus comprises a direct thermal printer having a first print head and a thermal transfer printer adjacent thereto and having a second print head. The printing apparatus is enclosed within a portable case. The method includes the step of coating the second side with a direct thermal coating, and the step of situating the label underneath the printing apparatus such that each of the first print head and the second print head face the first side. A controller is used to cause the direct thermal printer to print a second indicia on the second side while the first print head is facing the first side. The controller is further used to cause the thermal transfer printer to print a first indicia on the first side.

According to another embodiment, a method for printing a label having a first side, a second side opposing the first side, and a border comprises the step of providing a printing apparatus. The border is coated with an adhesive at the second side and a release liner is releasably secured thereto. The printing apparatus comprises a direct thermal printer having a first print head and a thermal transfer printer adjacent thereto and having a second print head. The printing apparatus also comprises an input device electronically coupled to a controller. The method includes the step of coating the second side with a direct thermal coating, and coating the first side with a thermal transfer coating. The method also includes the step of situating the label underneath the printing apparatus such that each of the first print head and the second print head face the first side. The controller is used to cause the direct thermal printer to print a second indicia on the second side and to cause the thermal transfer printer to print a first indicia on the first side. Each of the first indicia and the second indicia are printed while the release liner is releasably secured to the second side.

According to another embodiment, a method for printing a label having a first side, a second side opposing the first side, and a border comprises the step of providing a printing apparatus. The border is coated with an adhesive at the second side and a release liner is releasably secured thereto. The printing apparatus comprises a direct thermal printer having a first print head and a thermal transfer printer adjacent thereto and having a second print head. The printing apparatus also comprises an input device and an output device electronically coupled to a controller. The method includes the step of coating the second side with a direct thermal coating, and the step of situating the label underneath the printing apparatus such that each of the first print head and the second print head face the first side. The controller is used to cause the direct thermal printer to print a second indicia on the second side while the first print head is facing the first side, and to cause the thermal transfer printer to print a first indicia on the first side. Each of the first indicia and the second indicia are printed while the release liner is releasably secured to the second side.

According to yet another embodiment, a method for printing a substrate having a first side and a second side opposing the first side includes the step of providing a printing apparatus. The printing apparatus comprises a direct thermal printer having a first print head and a thermal transfer printer adjacent thereto and having a second print head. The apparatus further includes an input device, an output device, and a controller electronically coupled to each of the input device and the output device. The substrate is situated such that each of the first print head and the second print head face the first side. The controller is used to cause the direct thermal printer to print a second indicia on the second side while the first print head is facing the first side. The controller is further used to cause the thermal transfer printer to print a first indicia on the first side. The second side is coated with a direct thermal coating.

BRIEF DESCRIPTION OF THE SEVERAL VIEWS OF THE DRAWINGS

Illustrative embodiments of the present invention are described in detail below with reference to the attached drawing figures and wherein.

DETAILED DESCRIPTION

Labels (e.g., shipping labels, product identification labels, et cetera) are ubiquitous. Often, it is desirable to print on both sides of a label. For example, a shipping label secured to a package may include on one side information about the addressee (e.g., name of a recipient of the package, his address, et cetera), and on the other, information about the contents of the package (e.g., a listing of items included in the package, cost of the items included in the package, et cetera).

Figure 1:
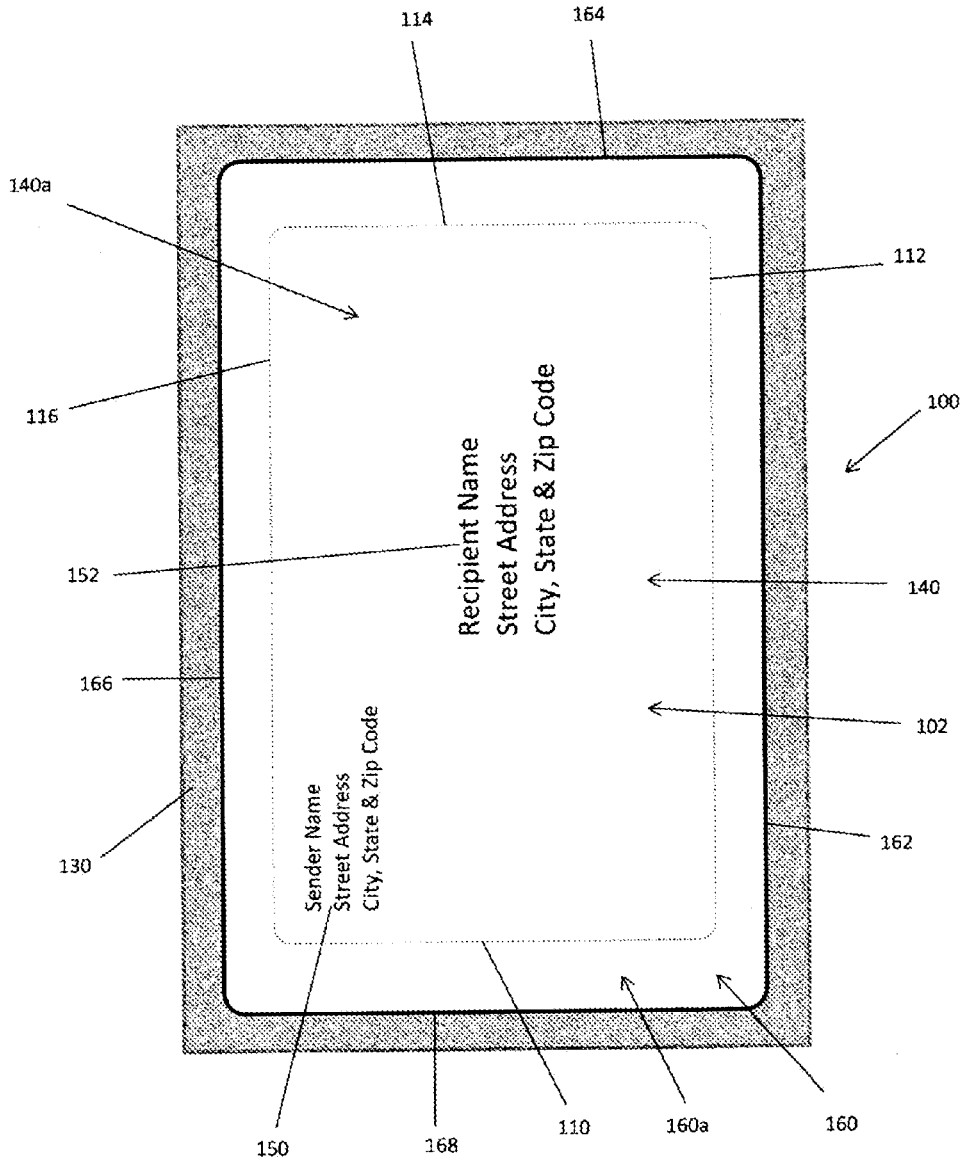
FIG. 1 shows a front side view of a shipping label printed in line with the teachings of the present invention.
Figure 2:
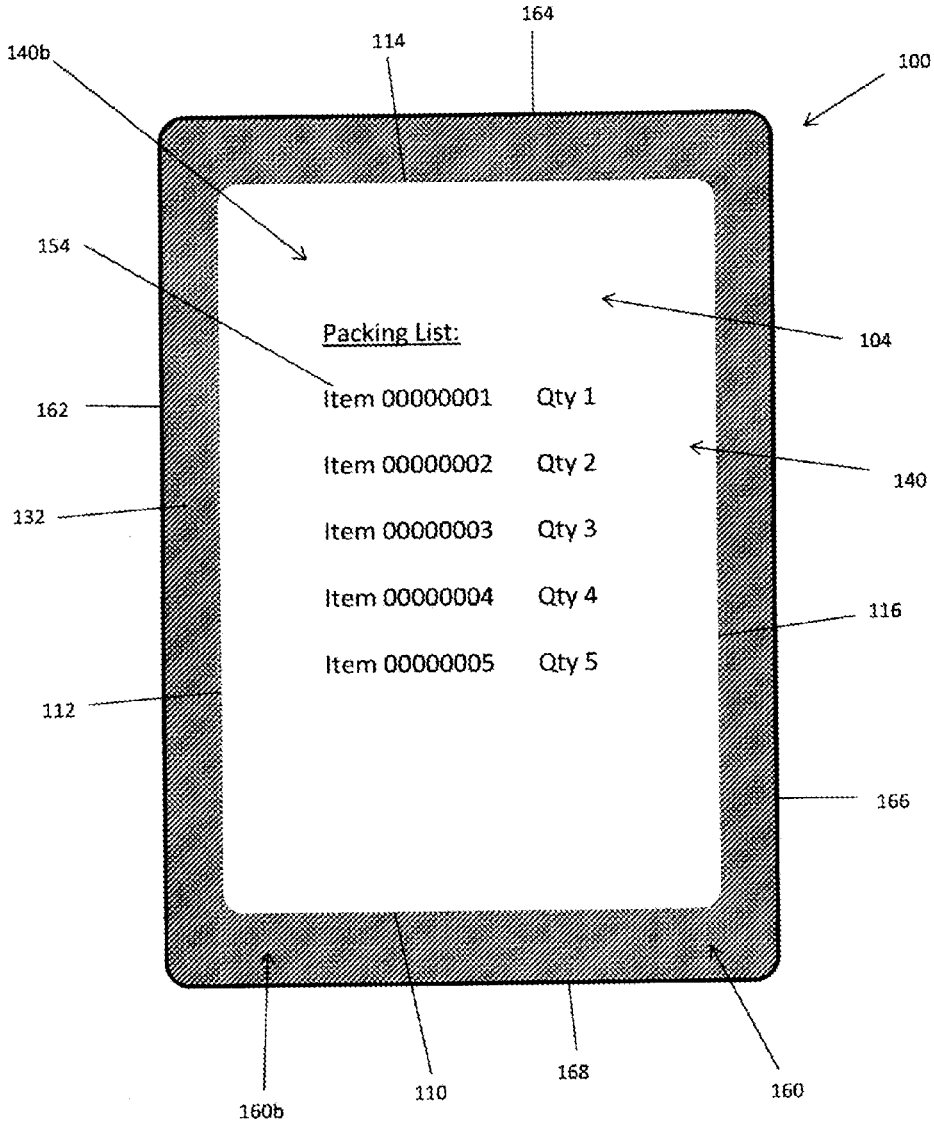
FIG. 2 shows a back side view of a shipping label printed in line with the teachings of the present invention.

FIGS. 1 and 2 respectively show a front side 102 and a back side 104 of a shipping label 100. The label 100 may, but need not, be generally rectangular, and include a center portion 140 having a front side 140*a* (see FIG. 1) and a back side 140*b* (see FIG. 2). The center portion 140 may be surrounded on all sides by a border 160 having a front side 160*a* and a back side 160*b*. The border 160 of the label 100 may have a first edge 162 that opposes a second edge 166, and a third edge 164 that that opposes a fourth edge 168. The corners of the label 100 may at least in some embodiments be rounded.

The center portion 140 may be configured to be separable from the label 100. For example, the label 100 may include a first perforated border 112 adjacent the first edge 162, a second perforated border 116 adjacent the second edge 166, a third perforated border 114 adjacent the third edge 164, and a fourth perforated border 110 adjacent the fourth edge 168. The perforated borders 110, 112, 114, and 116 may allow the center portion 140 to conveniently be physically separated from the border 160.

The front side 140*a* of the center portion 140 may include static or preprinted indicia 150, such as indicia identifying the name and address of the sender of a package to which the shipping label 100 is to be adhered. The front side 140*a* of the center portion 140 may also contain variable indicia 152. The variable indicia 152 may, for example, include the name of the recipient, his postal address, et cetera. Those skilled in the art will readily appreciate that both the static indicia 150 and the variable indicia 152 shown in the figures is exemplary only, and that the label 100 may include different static or variable indicia, and that in some embodiments, the label 100 may include only static or only variable indicia.

At the back side 104, the center portion 140*b* may include variable indicia 154. As shown in FIG. 2, the indicia 154 may be, for example, a packing list that includes a listing of the items to be included in the package, along with their quantity. The indicia 154 may also include other information. For example, in some embodiments, the variable indicia 154 may include instructions that outline for the recipient of the package information about how to use the one or more items in the package, how to store the items, et cetera. At least in some embodiments, the variable indicia 154 may include sensitive information that the recipient would not wish to be publically displayed on the front side 102 of the label 100.

The back side 160*b* of the border 160 (i.e., the area between the first edge 162 and the first perforated border 112, the second edge 166 and the second perforated border 116, the third edge 164 and the third perforated border 114, and the fourth edge 168 and the fourth perforated border 110) may be coated with an adhesive 132. The adhesive 132 may be, for example, a pressure sensitive adhesive or another adhesive, and may in some embodiments be included on the back side 160*b* of the border 160 in a pattern (such as in dots, circles, bars, stripes, grids, et cetera). A release liner or backing sheet 130 (see FIG. 1), that may cover the entire back side 104 of the label 100, may be releasably secured to the back side 160*b* of the border 160 via the adhesive 132. The backing sheet 130 may be made of paper, synthetic resin, or other desirable materials, and may include silicone or another release material that allows the backing sheet 130 to be easily separated from the back side 104 of the label 100. The backing sheet 130 may protect the label 100 and ensure that it does not inadvertently get adhered to a surface.

Figure 3:
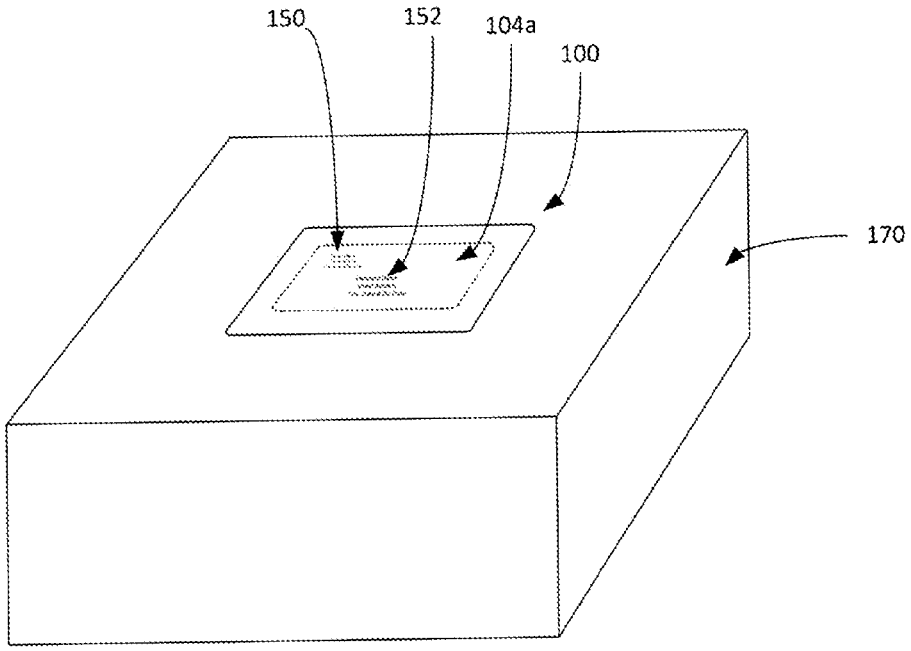
FIG. 3 shows a front side view of the shipping label of FIG. 1 adhered to a package.

When adhering the label 100 to a package 170 (see FIG. 3), the backing sheet 130 may first be removed to expose the adhesive 132, and the label 100 may be secured to the package 170 such that the back side 160*b* of the border 160 is adjacent and in contact with the surface of the package 170. As can be appreciated, when the label 100 is so adhered, the indicia 150, 152 on the front side 140*a* of the center portion 140 may be visible whereas the indicia 154 on the back side 140*b* of the center portion 140 may be hidden from view. Thus, it may be preferable to include any sensitive information on the back side 140*b* of the center portion 140.

Upon receipt of the package 170, the recipient may separate the center portion 140 of the label 100 from the border 160 along the first perforated border 112, the second perforated border 116, the third perforated border 114, and the fourth perforated border 110. Separating the center portion 140 from the border 160 in this fashion may allow the recipient to access the indicia 154 on the back side 140*b* of the center portion 140.

Figure 4:
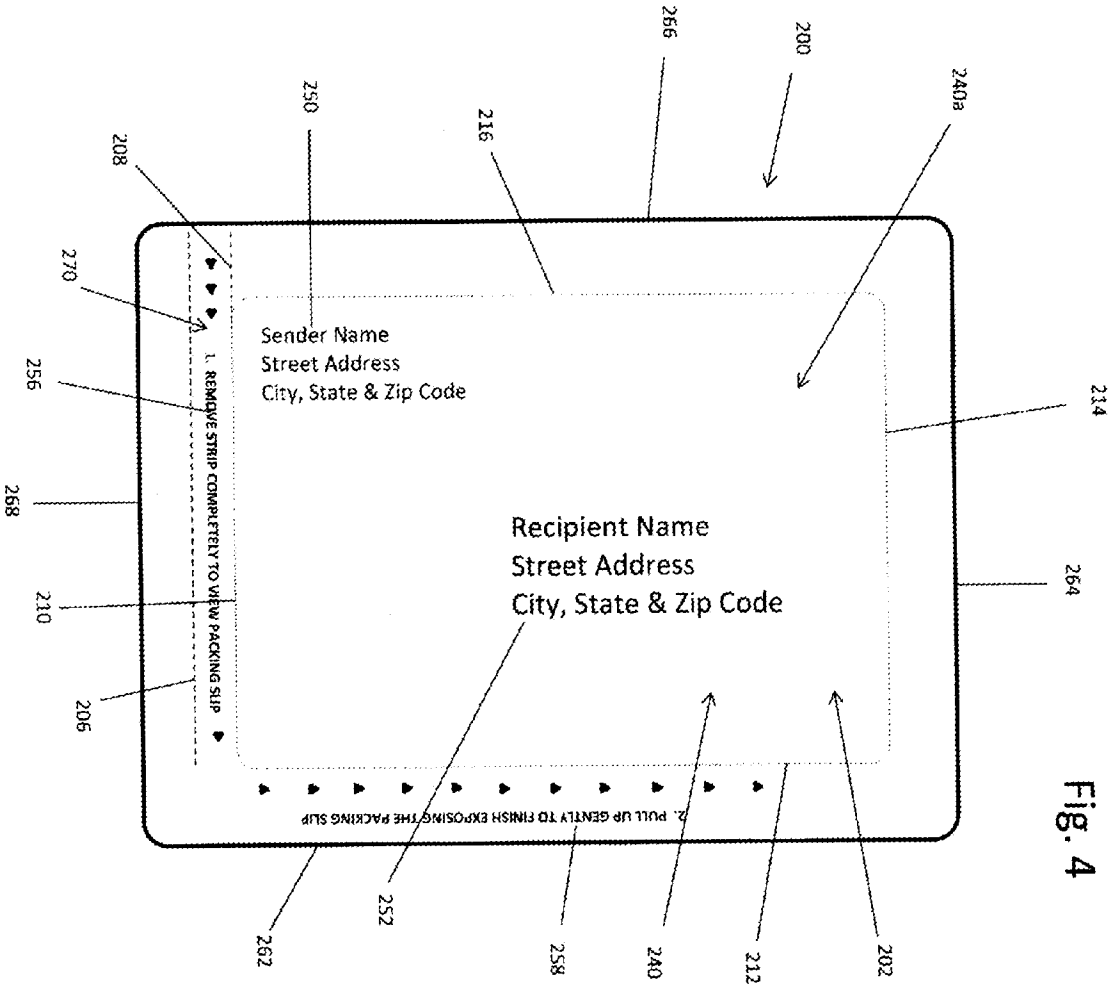
FIG. 4 shows a front side view of an alternate embodiment of the shipping label of FIG. 1, printed in line with the teachings of the present invention.

Attention is directed now to FIG. 4, which shows a front side view of an alternate embodiment 200 of the label 100. The embodiment 200 is substantially similar to the embodiment 100, except as specifically noted and/or shown, or as would be inherent. Akin to the center portion 140 of the label 100, the label 200 may have a center portion 240 having a front side 240*a*, which may include static (or preprinted) indicia 250 and variable indicia 252. The label 200 may also have perforated borders 210, 212, 214 and 216, and edges 268, 262, 264, and 266 respectively adjacent thereto. The main difference between the label 100 and the label 200 may be that the label 200 may include a tear strip 270 having perforated borders 206 and 208 opposing each other. As can be seen, the perforated borders 206, 208 may originate at the edge 266, may extend towards the edge 262, and may terminate prior to reaching the edge 262. The tear strip 270 may aid the recipient of the package 170 to separate the center portion 240 from the label 200. In some embodiments, the tear strip 270 may include static or preprinted indicia 256 outlining for the recipient the way in which the tear strip 270 is to be utilized. Additional instructions (such as indicia 258 between the edge 262 and the perforated border 212) may also be provided on the label 200.

Figure 5:
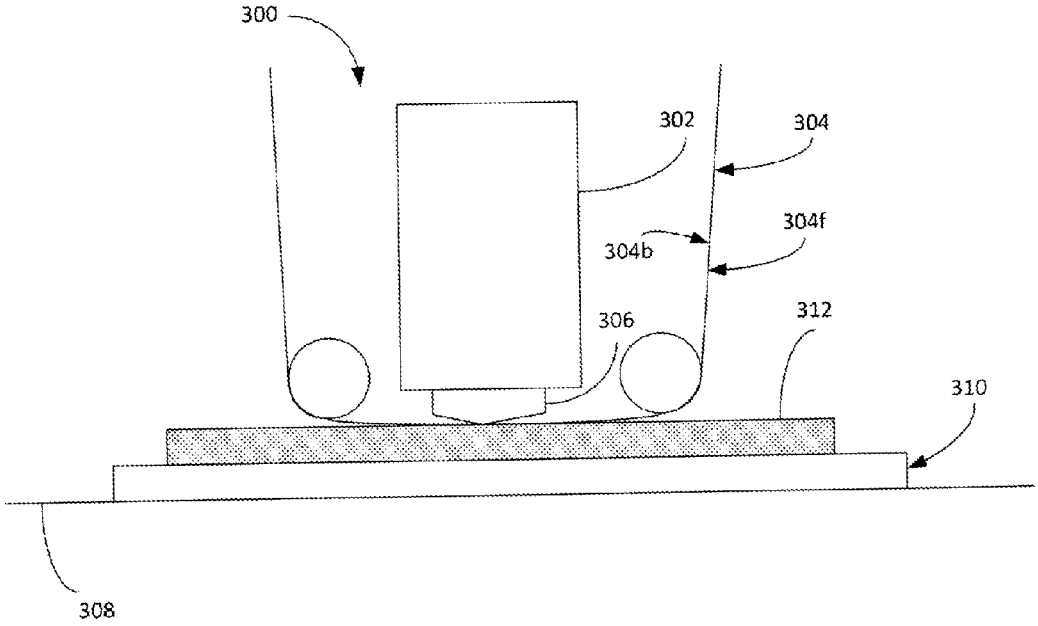
FIG. 5 shows a shipping label being printed with a thermal transfer printer.

Printing technologies have evolved over the years, and indicia (e.g., static indicia 150 and variable indicia 152, 154 of the label 100) may be printed on labels using one of many different types of printers (e.g., dot matrix printers, laser printers, et cetera). FIG. 5, for example, shows a thermal transfer printer 300 being used to print on one side of a substrate 310 (e.g., a label).

The thermal transfer printer 300 may include a body or housing 302, a thermal transfer ribbon 304 having a front side 304*f* and back side 304*b*, and a print head 306. The ribbon 304 may comprise carbon and/or other desirable materials. In some embodiments, the ribbon 304 may be coated with wax, or resin, or both. To print indicia on the substrate 310, the print head 306 may be heated. The heat from the print head 306 may heat the back side 304*b* of the ribbon 304, which may cause the thermal transfer ribbon 304 to melt and transfer the compounds (e.g., ink) on the front side 304*f* of the ribbon 304 onto the substrate 310 to form the indicia (hence the name "thermal transfer"). While not required, the substrate 300 may be placed on a conveyer belt 308 (or other similar mechanism) so that once the printing on the substrate 310 is completed, the substrate 310 may be moved from underneath the thermal transfer print head 306 and another substrate 310 may be brought in its place for printing. While not required, in some embodiments, a thermal transfer coating 312 may be situated atop the substrate 310 prior to printing. The thermal transfer coating 312 may facilitate the thermal transfer process and enhance the durability of the printed indicia.

Figure 6:
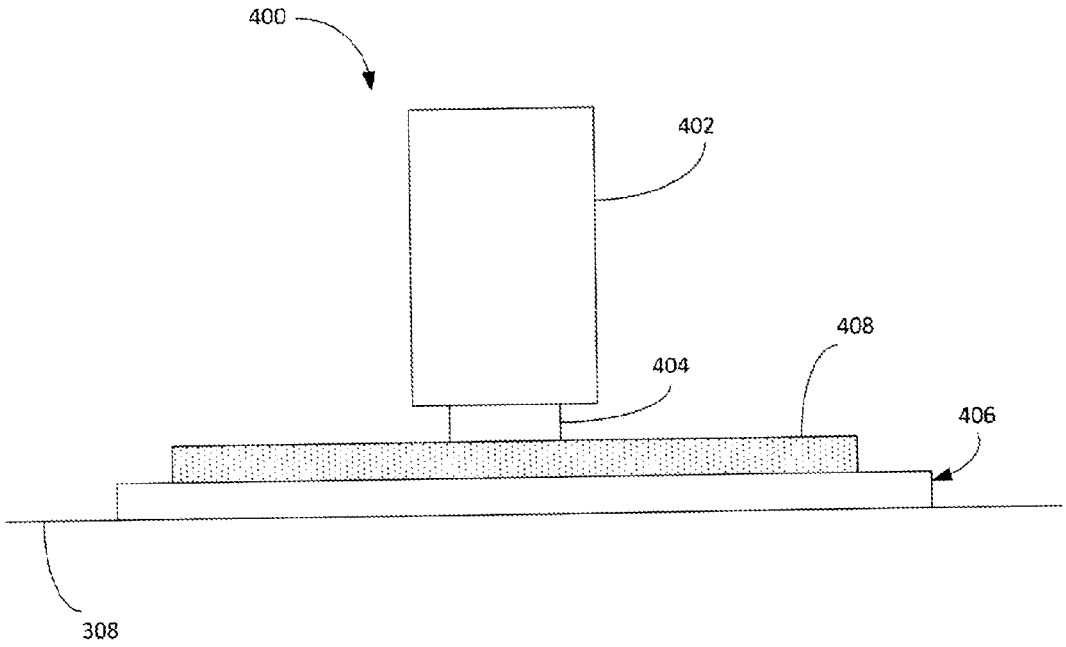
FIG. 6 shows a shipping label being printed with a direct thermal printer.

Attention is directed now to FIG. 6, which shows a direct thermal printer 400 being used to print on one side of a substrate 406 (e.g., a label). The direct thermal printer 400 may have a housing 402 and a print head 404. Direct thermal printers do not require a thermal transfer ribbon, ink, or toner. The substrate 406, prior to printing, may be coated with a direct thermal coating 408. When the substrate 406 is brought underneath the print head 404, the print head 404 may produce heat, which may cause the coating 408 to undergo a chemical reaction, thereby creating an image (e.g., printed indicia) on the substrate 406. As shown in FIG. 6, the substrate 406 may be placed on a conveyer belt 308 (or other similar mechanism) so that once the printing on the substrate 406 is completed, the substrate 406 may be moved from underneath the direct thermal print head 404 and another substrate 406 may be brought in its place for printing.

Figure 7:
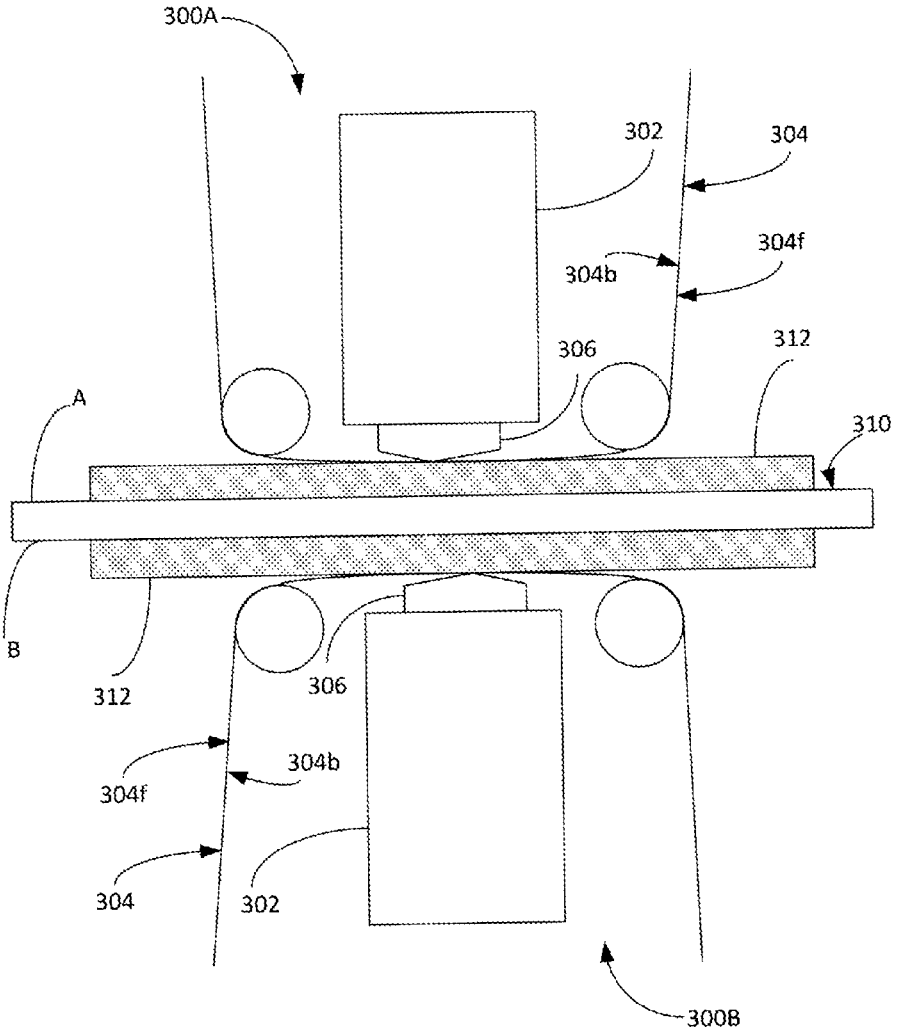
FIG. 7 (PRIOR ART)
FIG. 7 shows a front side and back side of the shipping label of FIG. 5 being printed with a first thermal transfer printer and a second thermal transfer printer, respectively, as in the prior art.

As noted above, it is often desirable to print on both sides of a substrate, such as a shipping label. FIG. 7 shows a prior art method for printing on both sides of the substrate 310. Specifically, as can be seen, a thermal transfer printer 300A may be used to print on a side A of the substrate 310, and a thermal transfer printer 300B may be used to print on a side B of the substrate 310. At least in some situations, the printer 300A may be placed upstream (or downstream) of the printer 300B. As can be seen, the printer 300A is adjacent the side A of the substrate 310 (i.e., facing that side of the substrate 310 that the printer 300A is being used to print) and the printer 300B is adjacent the side B of the substrate 310 (i.e., facing that side of the substrate 310 that the printer 300B is being used to print).

Figure 8:
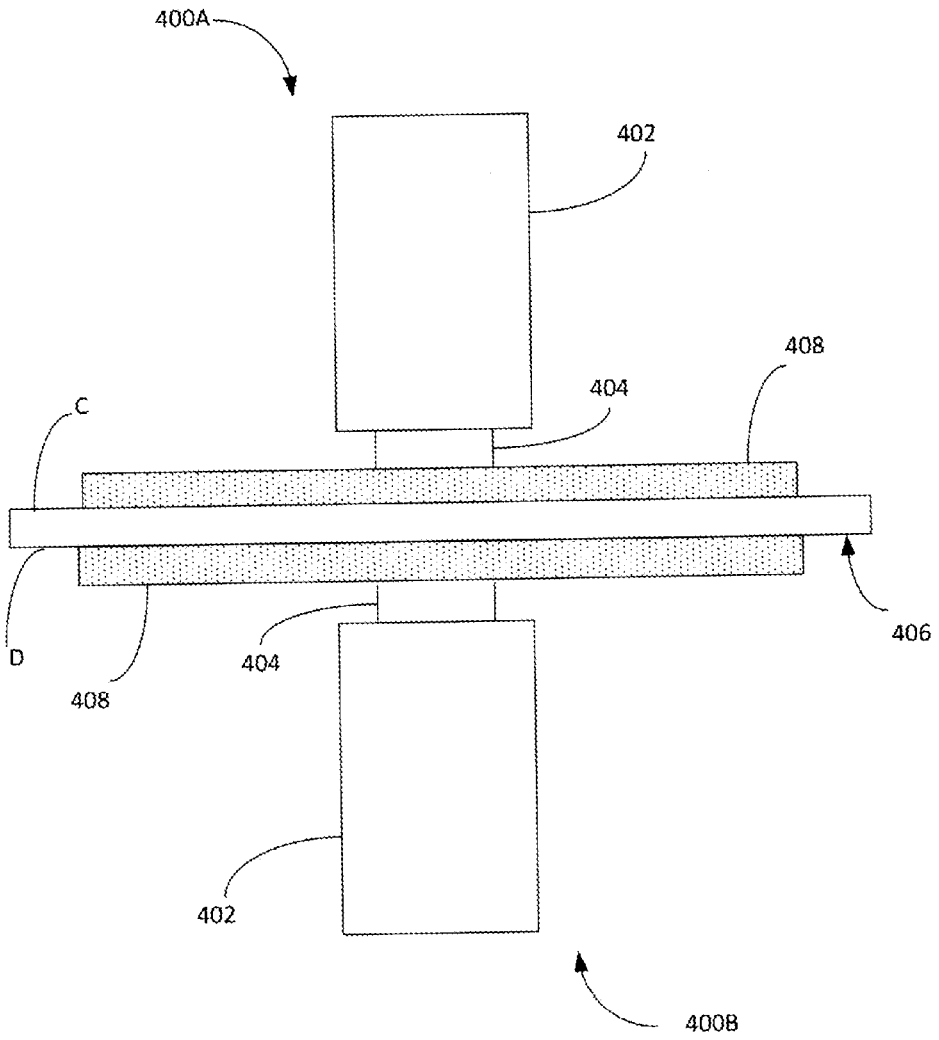
FIG. 8 (PRIOR ART)
FIG. 8 shows a front side and back side of the shipping label of FIG. 6 being printed with a first direct thermal printer and a second direct thermal printer, respectively, as in the prior art.

FIG. 8 shows a prior art method of printing on both sides C and D of the substrate 406 using direct thermal printing. Specifically, as can be seen, a direct thermal printer 400A may be situated adjacent the side C such that it faces the side C, and a direct thermal printer 400B may be situated adjacent the side D such that it faces the side D. At least in some situations, the direct thermal printer 400A may be placed upstream (or downstream) of the direct thermal printer 400B. As noted above, the direct thermal coating 408 may, unlike the optional thermal transfer coating 312 of FIG. 7, be required when printing using the direct thermal printers 400A, 400B.

Thermal transfer printers (such as the printer 300) have certain advantages as compared to direct thermal printers (such as the printer 400). For example, printing from direct thermal printers is generally limited to black print, whereas thermal transfer printers, because of the availability of ribbons 304 of various colors, may be used to print colored images. Thermal transfer print heads 306 may also have a longer life than direct thermal print heads 404. This is in part because in direct thermal printing, the print head generally contacts the substrate directly as it is pulled across the print head, causing wear and tear, whereas in thermal transfer printing, the ribbon 304 acts as a buffer between the substrate and the thermal transfer print head 306. Similarly, foreign objects (e.g., dust, debris, et cetera) present on labels being printed with direct thermal printers impact the direct thermal print head 404 directly, whereas in thermal transfer printing, such foreign objects generally do not reach the print head 306 because of the ribbon 304. Additionally, thermal transfer printers 300 may be used to print on many different kinds of substrates 130, such as film, paper, polyester, propylene, and even foil substrates, whereas the types of substrates that may be printed using direct thermal printers are more limited. For example, it is generally unadvisable to use direct thermal printers to print on abrasive substrates.

The reverse, however, is also true. That is, direct thermal printers also have certain advantages over thermal transfer printers. For example, because direct thermal printers do not use the ribbon 304, the costs associated with purchasing and replacing the ribbons 304 is not a concern in direct thermal printing. Direct thermal printers are also considered to be environmentally friendlier than thermal transfer printers, because there are no used ink ribbons that need to be disposed.

Locating the thermal transfer printer 300A so that it faces side A of the substrate 310 (see FIG. 7) and the thermal transfer printer 300B so that it faces side B of the substrate 310 may be more cumbersome than locating both the thermal transfer printers 300A, 300B side by side such that they both face the side A (or the side B) of the substrate 310. In this configuration, it may also be easier to service the printers 300A, 300B. However, in such a configuration, the side B of the substrate 300 would not receive any print, which is undesirable. It may also be possible to use one printer (e.g., printer 300A or 400A) to print on one side of the substrate, and to then turn the substrate around so that its other side could be printed; this process too, however, may be costly and/or labor intensive. It would be advantageous if two printers could be placed adjacent each other such that they face the same side of the substrate, but cause the substrate to be printed on both sides. It would also be advantageous if a direct thermal printer could be used to print on one side of the substrate and a thermal transfer printer to print the other side, as then, the advantages of both direct thermal printers and thermal transfer printers may be realized. The present invention is directed to such systems and methods.

Figure 9:
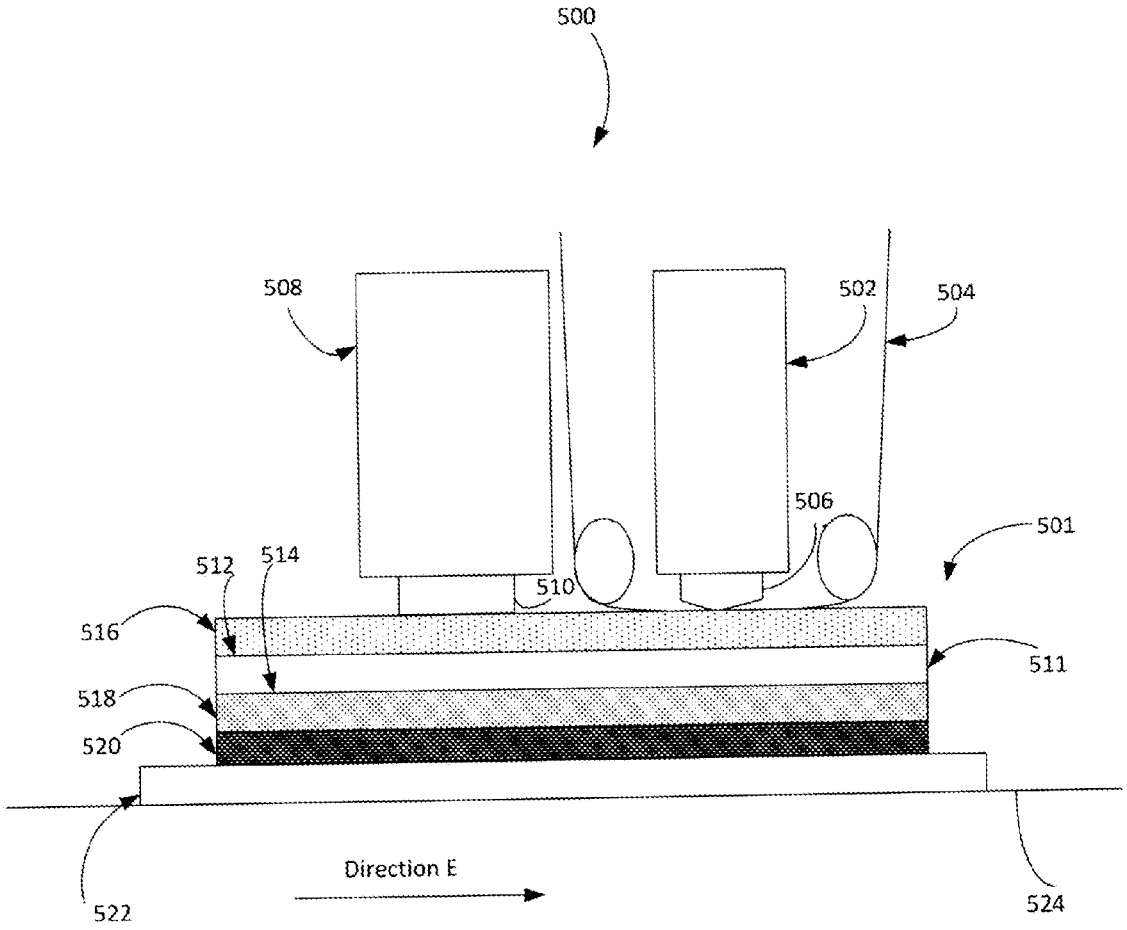
FIG. 9 shows a front side and back side of a shipping label being printed with a printer in line with the teachings of the current invention.

Attention is directed now to FIG. 9 which shows a printer (or "printing apparatus") 500 in line with the teachings of the current invention being used to print a label 501, which is generally similar to the label 100 of FIGS. 1-2. Specifically, the label 501 may include a substrate 511 having a first side 512 and a second side 514, which may respectively be generally similar to the front side 102 and the back side 104 of the label 100. The first side 512 may be coated with a thermal transfer coating 516 and the second side 514 may be coated with direct thermal coating 518. The label 501 may include a layer of adhesive 520 underneath the direct thermal coating 518, which may be generally similar to the adhesive 132 of the label 100. A backing sheet 522, which may be generally similar to the backing sheet 130 of the label 100, may be provided downwardly adjacent the adhesive 520. While not required, the label 501 may be placed on a conveyer belt (or other similar mechanism) 524 that moves in the direction E. It will be appreciated that the dimensions of some of the elements in FIG. 9 (and the other figures) have been exaggerated for clarity.

The printer 500 may include a thermal transfer printer 502 having a ribbon 504 and a print head 506. The printer 500 may also include a direct thermal printer 508 having a print head 510. The printers 502, 508 may be adjacent each other and, at least in some embodiments, may not have a significant distance between them. For example, in some embodiments, the printers 502, 508 may be within a foot of each other, or even within six inches of each other or less. In other embodiments, the distance between the printers 502, 508 of the printer 500 may be greater than a foot. As can be seen, the print heads 506, 510 of both the thermal transfer printer 502 and the direct thermal printer 508, respectively, face the first side 512 of the label 501.

Figure 10:
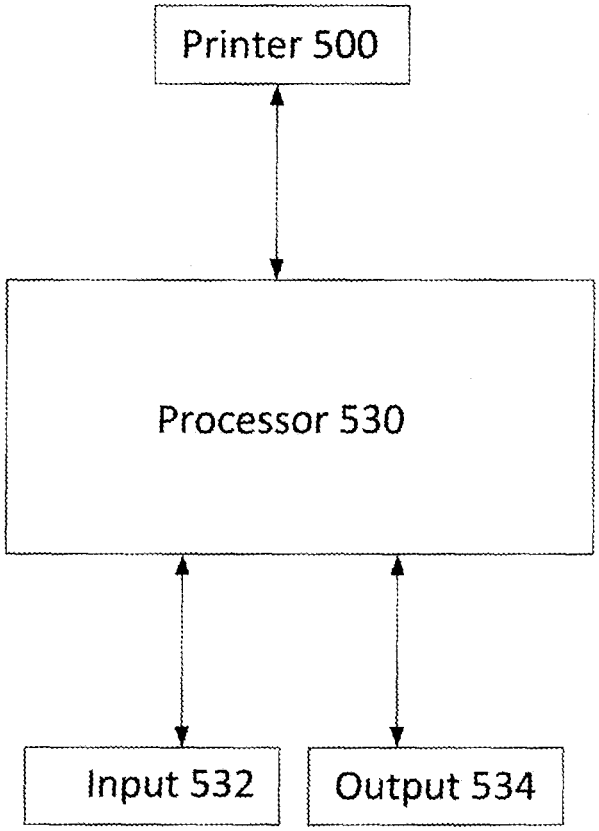
FIG. 10 shows a schematic illustrating electronic communication between the printer of FIG. 9 and a controller.

At least in some embodiments, as shown in FIG. 10, the printer 500 may be controllable via a controller or processor 530. The controller 530 may include an input device 532 and an output device 534. The input device 532 may comprise, for example, keys, knobs, switches, a keyboard, and other input devices 532 now known or later developed. The output device 534 may include, for example, speakers, alarms, displays, et cetera. In some embodiments, the input device 532 and the output device 534 may be combined into one device (e.g., a touch screen). The controller 530 may in some embodiments be located within a housing of the printer 500. In other embodiments, the controller 530 may be part of a desktop computer, a laptop computer, a smart phone, a tablet, et cetera, to which the printer 500 may be communicatively coupled. The controller 530 may allow a user to, among other things, turn a print head (e.g., the print head 506 or the print head 510) on and off, activate both print heads 510, 506 together, set and change temperature settings of the print heads 506, 510, automate the time for which each print head 506, 510 is activated, et cetera.

Figure 11:
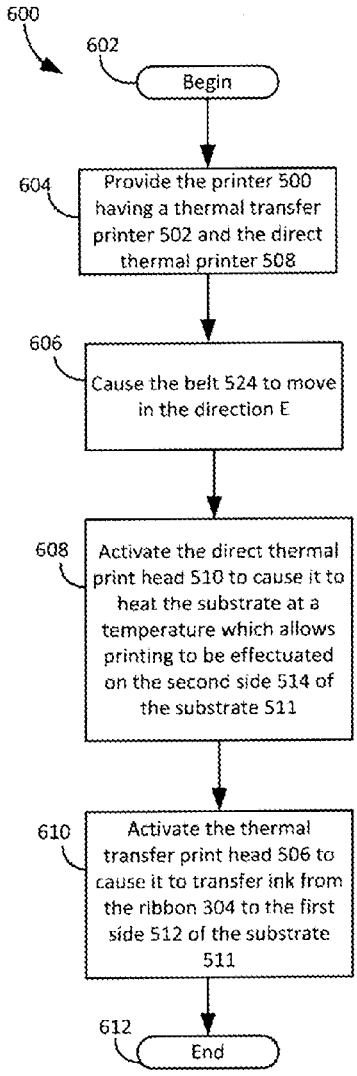
FIG. 11 shows a method for printing the front side and the back side of the label of FIG. 9 with the printer of FIG. 9, according to an embodiment.

Attention is directed now to FIG. 11, which shows a method 600 of using the printer 500 to print the label 501. The method 600 may begin at step 602, and at step 604, the user may provide the printer 500 for printing. At step 606, which may be an optional step, the user may cause the conveyer belt 524 to move in the direction E so that the label 501 is underneath the print heads 510, 506 (or at least underneath the direct thermal print head 510). In other embodiments, the label 501 may be manually placed underneath the print heads 510, 506. At step 608, the user may use the controller 530 to activate the direct thermal print head 510. The temperature of the direct thermal print head 510 may be sufficient to cause the heat to transfer from the direct thermal print head 510 through the thermal transfer coating 516 and the substrate 511 such that printing is effectuated (via the chemical reactions, as discussed above) on the second side 514 (i.e., the underside) of the label 501. To facilitate such heat transfer, at least in some embodiments: (i) the thermal transfer coating 516 may be omitted; and/or (ii) a relatively thin substrate 511 may be used, which may also equate to lower cost. In other embodiments, however, the thermal transfer coating 516 may not be omitted. It will be appreciated that because the printing is being effectuated on the reverse side of the label 501 (i.e., the side 514 that is not in direct contact with the print head 510), that the printing that the print head 510 is programmed to print will be a minor image of the printing that is to appear on the side 514. In this manner, at step 608, the user may print indicia (e.g., variable indicia, such as the packing list 154 of the label 100) on the second side 514 of the label 501.

At step 610, the user may use the controller 530 to activate the thermal transfer print head 506. The heat from the thermal transfer print head 506 may cause the ink from the ribbon 504 to be transferred on the first side 512 of substrate 511 (e.g., in this manner, at step 610, the user may print the variable indicia 152 (or the static indicia 150) on the front side 102 of the label 100). The method may then end at step 612.

It will be readily appreciated that the settings (e.g., temperature settings, timing settings) of the printer 500 may be set in advance via the controller 530 such that many labels 501 may be printed out in succession. In some embodiments, the process of replacing a printed label with a to-be printed label may be automated (e.g., via the belt 524).

The time between step 608 and 610 may be minimal. For example, in some embodiments, less than five seconds after the direct thermal printing is effectuated at step 608, the thermal transfer printing may be effectuated at step 610. In other embodiments, particularly where the size of the substrate 511 is larger, both the steps 608 and 610 may be carried out generally simultaneously.

Thus, as can be appreciated, the printer 500 and the method 600 may allow a user to print on both sides of a label without having to ensure that one printer is located adjacent each side. Further, as disclosed herein, the adhesive layer 520 and the backing sheet 522 adjacent the second side 514 of the label 511 and the direct thermal coating 518 may not be an impediment to the printing whatsoever, because the printing of both sides of the label 511 is being effectuated via the print heads 506, 510 facing the first side 512.

While the disclosure herein shows that in the preferred embodiment the direct thermal printing is effectuated before the thermal transfer printing (or in simultaneity therewith), in some embodiments, the thermal transfer printing may be effectuated before the direct thermal printing.

Figure 12:
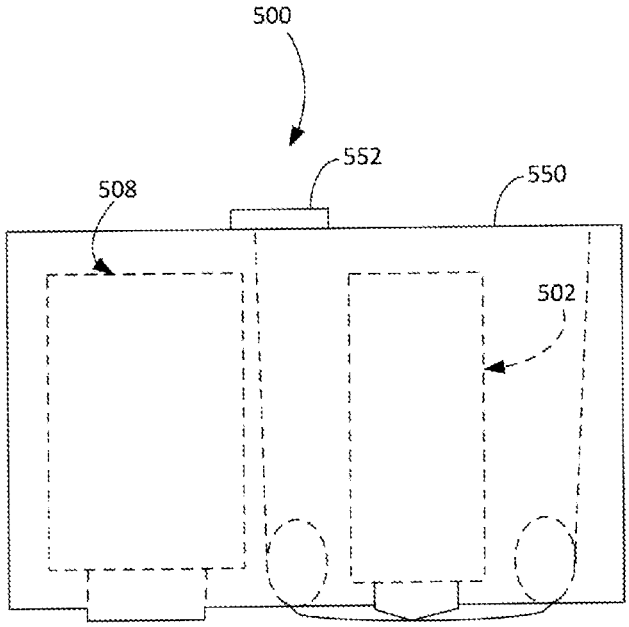
FIG. 12 shows the printer of FIG. 9 enclosed in a housing.

The printer 500 may, in some embodiments, include a case or housing 550 (see FIG. 12) that encloses both the direct thermal printer 508 and the thermal transfer printer 502. The housing 550 may be configured so as to ensure that the print heads of both the direct thermal printer 508 and the thermal transfer printer 502 are at least partially exposed so that printing may properly be effectuated. The housing 550 may include a door (not specifically shown) to allow access into the housing 550 (e.g., to allow the ribbon of the thermal transfer printer to be replaced or to allow other maintenance to be conducted). The housing 550 may include a handle 552 that allows the printer 500 to be conveniently transported from one location to another; that is, in some embodiments, the printer 500 may be mobile. The housing 550 may protect the printer 500 from the elements. In some embodiments, one or more of the input device 532, the output device 534, and the processor 530 may be situated within the housing.

It will be appreciated from the disclosure herein that while the substrate is generally disclosed as being a label (e.g., a shipping label), that this is not a requirement, and that in embodiments, the substrate may be something other than a label (e.g., a receipt, a card (such as a business card, a loyalty card, et cetera), a form, or any other substrate that is to be printed on both sides.) Moreover, while the printing apparatus 500 is shown as being situated above the substrate 511 in the vertical plane in FIG. 9 (i.e., facing the first side 512 thereof), this too is not a requirement, and in embodiments, the printing apparatus 500 may be placed below the substrate 511 such that both the print heads 506, 510 face the second side 514. Terms such as "first side", "second side", "above", "below", et cetera, are used to convey the workings of invention in a typical orientation or configuration, but are not independently limiting.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A method for printing a label; the label having a first side, a second side opposing the first side, and a border; the border being coated with an adhesive at the second side; a release liner being releasably secured to the second side via the adhesive; the method comprising steps:

providing a printing apparatus, comprising:

a direct thermal printer having a first print head;

a thermal transfer printer adjacent the direct thermal printer, the thermal transfer printer having a second print head; and a portable case for housing the direct thermal printer and the thermal transfer printer;

coating the second side with a direct thermal coating;

situating the label underneath the printing apparatus such that each of the first print head and the second print head face the first side;

using a controller to cause:

the direct thermal printer to print a second indicia on the second side while the first print head is facing the first side; and the thermal transfer printer to print a first indicia on the first side.

2. The method of claim 1, wherein the label is a shipping label.

3. The method of claim 2, wherein the second indicia includes a packing list.

4. The method of claim 3, further comprising the step of coating the first side with a thermal transfer coating.

5. The method of claim 4, wherein the label includes a center portion; the center portion being physically separable from the border.

6. The method of claim 5, wherein the label comprises a tear strip to facilitate the separation of the center portion.

7. The method of claim 6, wherein the second indicia is printed before the first indicia.

8. The method of claim 7, wherein the first indicia is printed within five seconds of the printing of the second indicia.

9. The method of claim 6, wherein the first indicia and the second indicia are printed generally simultaneously.

10. The method of claim 9, wherein a thickness of the label is configured to facilitate the transfer of heat from the first print head through the label to effectuate the printing of the second indicia.

11. A method for printing a label; the label having a first side, a second side opposing the first side, and a border; the border being coated with an adhesive at the second side; a release liner being releasably secured to the second side via the adhesive; the method comprising steps:

providing a printing apparatus, comprising:

a direct thermal printer having a first print head;

a thermal transfer printer adjacent the direct thermal printer, the thermal transfer printer having a second print head; and an input device electronically coupled to a controller;

coating the first side with a thermal transfer coating;

coating the second side with a direct thermal coating;

situating the label underneath the printing apparatus such that each of the first print head and the second print head face the first side;

using the controller to cause:

the direct thermal printer to print a second indicia on the second side; and the thermal transfer printer to print a first indicia on the first side;

wherein each of the first indicia and the second indicia are printed while the release liner is releasably secured to the second side.

12. The method of claim 11, wherein the label includes a center portion and a tear strip.

13. The method of claim 12, wherein the center portion is separable from the border.

14. The method of claim 13 wherein each of the first indicia and the second indicia is printed on the center portion.

15. The method of claim 14 wherein:

the adhesive is a pressure sensitive adhesive; and the release liner comprises silicone.

16. A method for printing a label; the label having a first side, a second side opposing the first side, and a border; the border being coated with an adhesive at the second side; a release liner being releasably secured to the second side via the adhesive; the method comprising steps:

providing a printing apparatus, comprising:

a direct thermal printer having a first print head;

a thermal transfer printer adjacent the direct thermal printer, the thermal transfer printer having a second print head;

a controller;

an input device and an output device, each being electronically coupled to the controller;

coating the second side with a direct thermal coating;

situating the label underneath the printing apparatus such that each of the first print head and the second print head face the first side;

using the controller to cause:

the direct thermal printer to print a second indicia on the second side while the first print head is facing the first side; and the thermal transfer printer to print a first indicia on the first side;

wherein each of the first indicia and the second indicia are printed while the release liner is releasably secured to the second side.

17. The method of claim 16, wherein the label is a shipping label.

18. The method of claim 17, wherein the second indicia includes a packing list.

19. The method of claim 17, further comprising the step of coating the first side with a thermal transfer coating.

20. The method of claim 19, wherein the printing apparatus is housed in a portable case; the first print head and the second print head being exposed within the case.

21. A method for printing a substrate; the substrate having a first side and a second side opposing the first side; the method comprising steps:

providing a printing apparatus, comprising:

a direct thermal printer having a first print head;

a thermal transfer printer adjacent the direct thermal printer, the thermal transfer printer having a second print head;

a controller;

an input device and an output device, each being electronically coupled to the controller;

situating the substrate such that each of the first print head and the second print head face the first side;

using the controller to cause:

the direct thermal printer to print a second indicia on the second side while the first print head is facing the first side; and the thermal transfer printer to print a first indicia on the first side;

wherein the second side is coated with a direct thermal coating.

* * * * *